US010933275B2

(12) United States Patent
Strickland

(10) Patent No.: US 10,933,275 B2
(45) Date of Patent: Mar. 2, 2021

(54) GLUTEUS MAXIMUS POWER PUSH APPARATUS

(71) Applicant: Kenneth Strickland, Canyon Country, CA (US)

(72) Inventor: Kenneth Strickland, Canyon Country, CA (US)

( * ) Notice: Subject to any disclaimer, the term of this patent is extended or adjusted under 35 U.S.C. 154(b) by 0 days.

(21) Appl. No.: 16/128,368

(22) Filed: Sep. 11, 2018

(65) Prior Publication Data

US 2019/0076694 A1 Mar. 14, 2019

Related U.S. Application Data

(60) Provisional application No. 62/556,822, filed on Sep. 11, 2017.

(51) Int. Cl.

| | |
|---|---|
| ***A63B 21/00*** | (2006.01) |
| ***A63B 21/062*** | (2006.01) |
| ***A63B 23/035*** | (2006.01) |
| ***A63B 23/04*** | (2006.01) |
| ***A63B 69/00*** | (2006.01) |

(52) U.S. Cl.

CPC ..... *A63B 21/4034* (2015.10); *A63B 21/063* (2015.10); *A63B 21/0628* (2015.10); *A63B 21/4045* (2015.10); *A63B 23/03508* (2013.01); *A63B 23/03575* (2013.01); *A63B 23/0417* (2013.01); *A63B 21/154* (2013.01); *A63B 69/0057* (2013.01); *A63B 2023/0411* (2013.01); *A63B 2225/093* (2013.01)

(58) Field of Classification Search

CPC ... A63B 21/06; A63B 21/062; A63B 21/0626; A63B 21/0628; A63B 21/063; A63B 21/15; A63B 21/151; A63B 21/154; A63B 21/40; A63B 21/4027; A63B 21/4033; A63B 21/4034; A63B 21/4041; A63B 21/4045; A63B 22/0025; A63B 2022/0028; A63B 2022/0033; A63B 23/035; A63B 23/03508; A63B 23/03575; A63B 23/04; A63B 23/0405; A63B 23/0411; A63B 23/0417; A63B 69/0048; A63B 69/0057; A63B 2225/09; A63B 2225/093; A63B 2023/0411

See application file for complete search history.

(56) References Cited

U.S. PATENT DOCUMENTS 4,846,461 A * 7/1989 Robards, Jr. ..... A63B 22/0076 482/72
2017/0291057 A1* 10/2017 Strickland ..... A63B 21/0628

OTHER PUBLICATIONS

Nautilus IPGM3 Assembly Manual. Publication Date: Apr. 11, 2017. https://support.corehandf.com/Brands/Nautilus/Drawings/IPGM3.pdf (Year: 2017).*

(Continued)

*Primary Examiner* — Andrews S Lo
(74) *Attorney, Agent, or Firm* — MU P.C.

(57) ABSTRACT

A power push exercise apparatus comprises a frame assembly to house a weight system of selectable stacked weights. A foot assembly is provided in a workout space, such that a user may provide a downward force on the foot assembly to engage the weight system and perform exercises targeting the gluteus maximus.

13 Claims, 8 Drawing Sheets

(56) References Cited

OTHER PUBLICATIONS

Fitness Direct Nautilus Inspiration Glute Press. Publication Date: Jul. 1, 2017. https://www.fitdir.com/nautilus-inspiration-glute-press.html (Year: 2017).*
Wayback Machine Fitness Direct Nautilus Inspiration. https://web.archive.org/web/2017/https://www.fitdir.com/nautilus-inspiration-glute-press.html (Year: 2017).*
Nautilus IPGM3 Revision B Assembly Manual Date. https://corehealthandfitness.force.com/customer/s/support-site?language=en_US (Year: 2017).*

* cited by examiner

GLUTEUS MAXIMUS POWER PUSH APPARATUS

CROSS-REFERENCE TO RELATED APPLICATION(S)

The present application claims priority to U.S. Provisional Patent Application No. 62/556,822 filed on Sep. 11, 2017, entitled "Gluteus Maximus Power Down Apparatus" the entire disclosure of which is incorporated by reference herein.

BACKGROUND OF THE INVENTION

1. Field of Invention

The present invention relates to the field of exercise apparatuses.

2. Description of Related Art

In recent years, having a shapely rear has become somewhat of a trend in fitness. Pop icons such as Kim Kardashian and Nicki Minaj have brought have brought large gluteus maximus muscles into the spotlight, and fitness conscious individuals have started to focus more on strengthening their gluteus maximus to follow the trend.

Traditionally, enhancing and strengthening the gluteus maximus has been accomplished through repetitive exercise motions, specifically squats. Squats can be done without weights. However, to gain real definition and strength quickly in the gluteal region squats should be done with weights. Traditionally, weighted squats are done with a barbell placed across the shoulders of the squatter.

While weighted squats provide sufficient resistance to successfully tone and exercise the gluteus maximus, they can be dangerous. Improper form or too much weight could lead to severe injury, especially to the squatter's back.

Based on the foregoing, there is a need in the art for a gluteus maximus strengthening apparatus which provides a safe, weighted resistance for the user.

SUMMARY OF THE INVENTION

In an embodiment, an exercise apparatus comprises a frame assembly and a weight system having a plurality of weight plates in communication with the frame assembly. In an embodiment, a support bar is provided at the distal end of the apparatus, and a workout space is provided between the frame assembly and the support bar.

In an embodiment, a foot assembly in communication with the weight system and provided within workout space, the foot assembly configured to receive a user's foot. The apparatus is further provided a tube array and one or more support pads having a protrusion configured to be received by the tube array.

In an embodiment, the foot assembly engages the weight system, and downward movement of the foot assembly by the user is transferred through one or more pulleys to the weight system via a cable. Therefore, the weight system provides a selective resistance against downward movement of the foot assembly.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
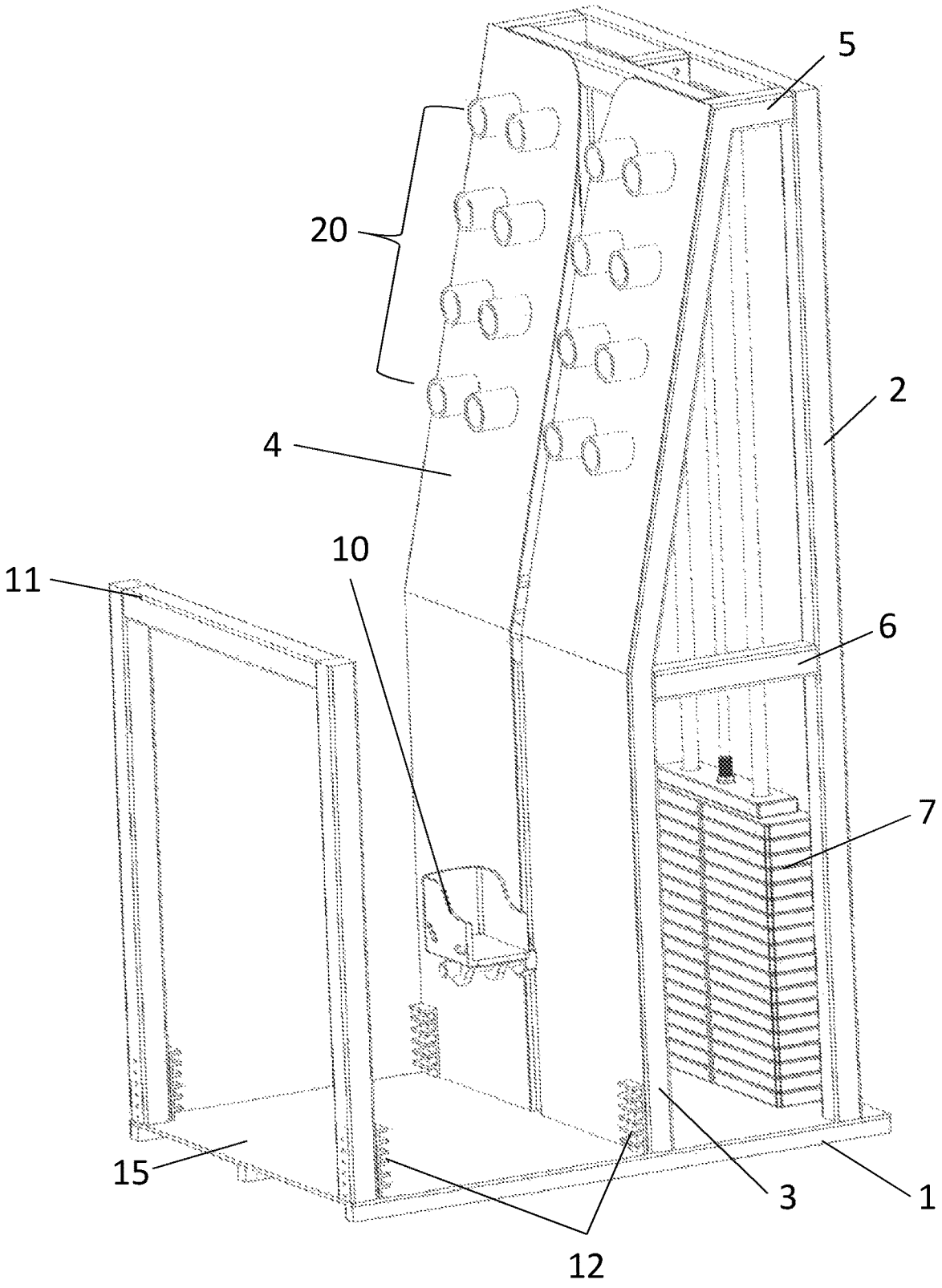
FIG. 1 is a perspective view of the power push apparatus, according to an embodiment of the present invention.
Figure 2:
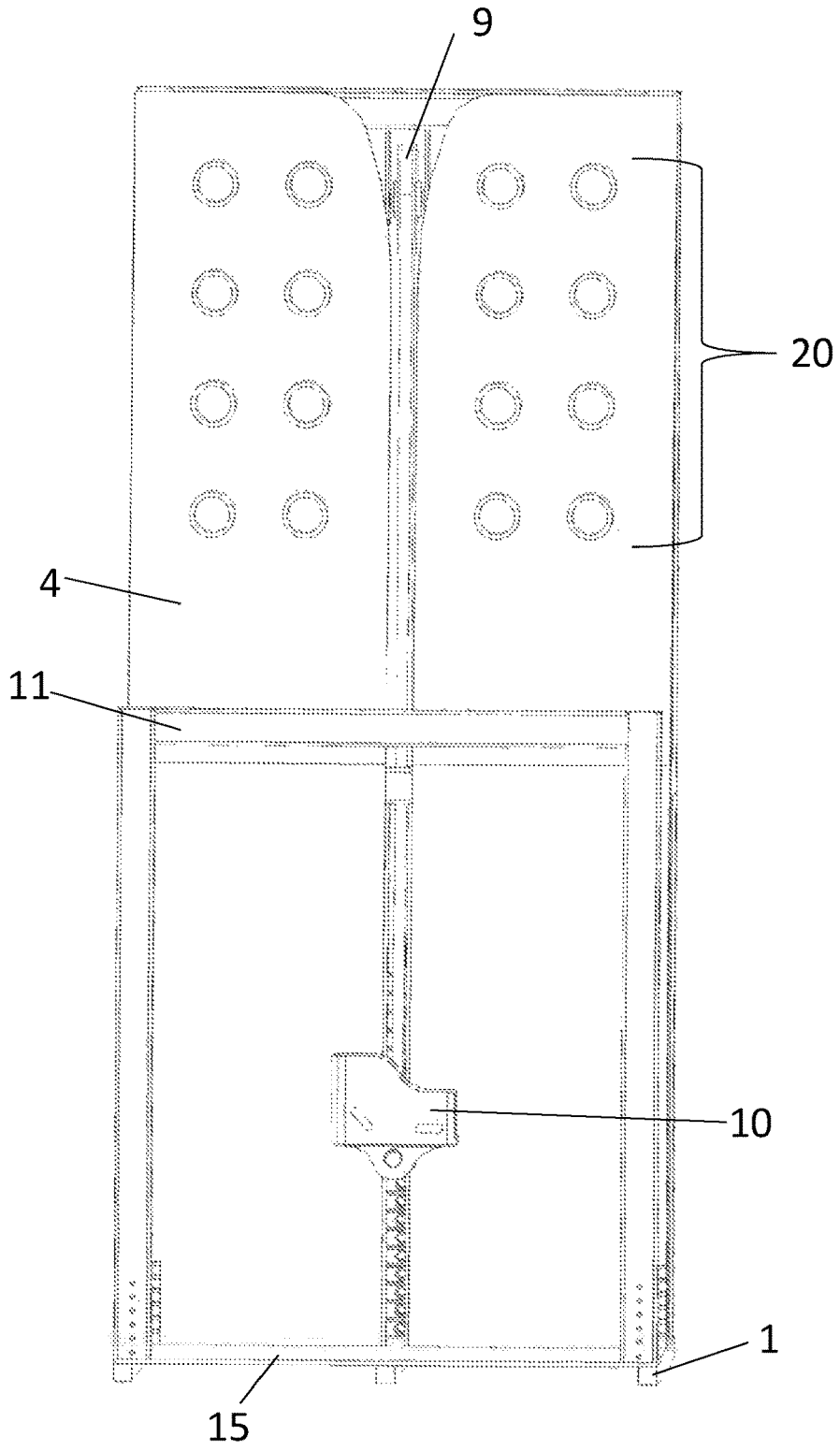
FIG. 2 is front elevational view of the power push apparatus, according to an embodiment of the present invention.
Figure 3:
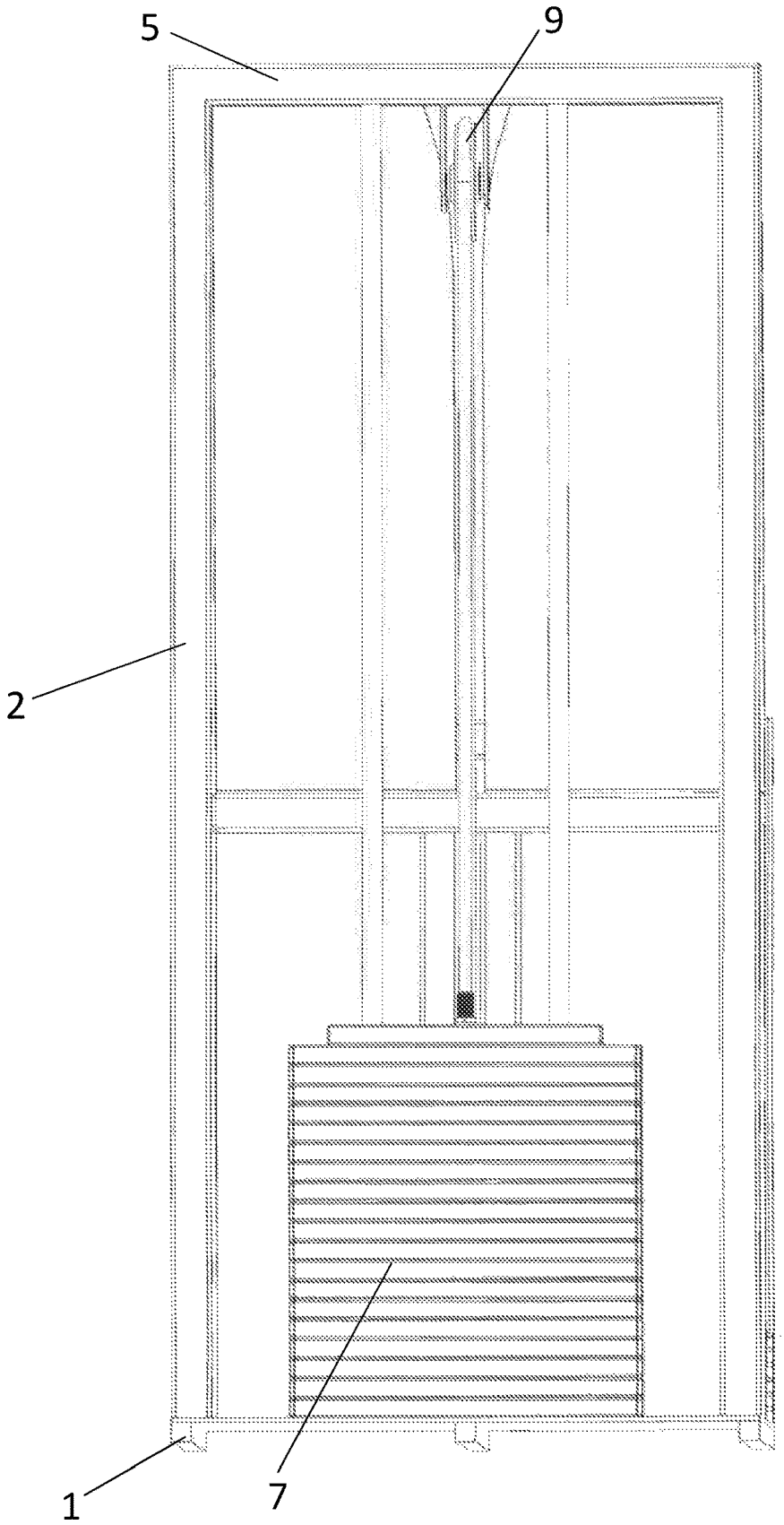
FIG. 3 is front elevational view of the power push apparatus, according to an embodiment of the present invention.
Figure 4:
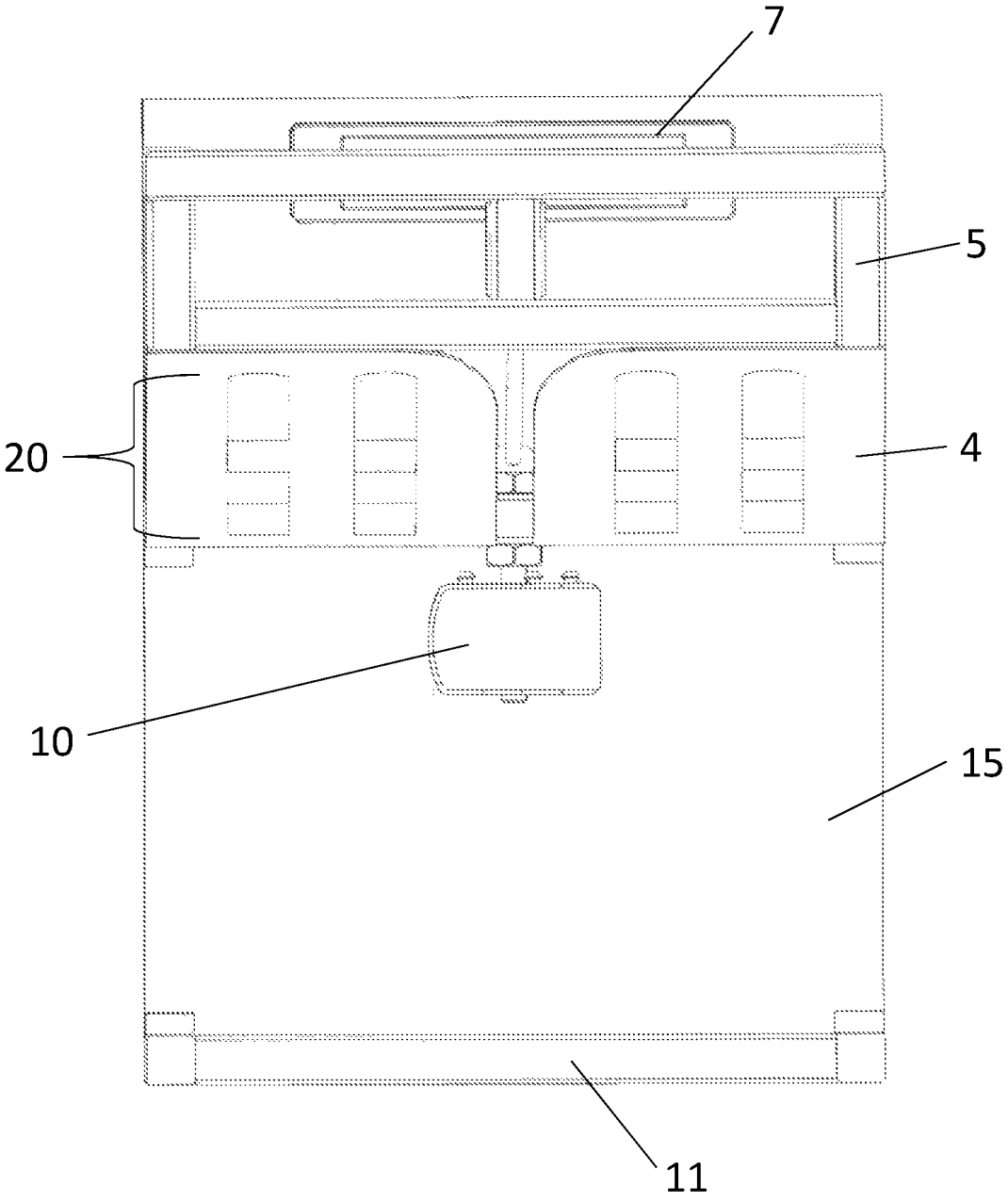
FIG. 4 is a top plan view of the power push apparatus, according to an embodiment of the present invention.
Figure 5:
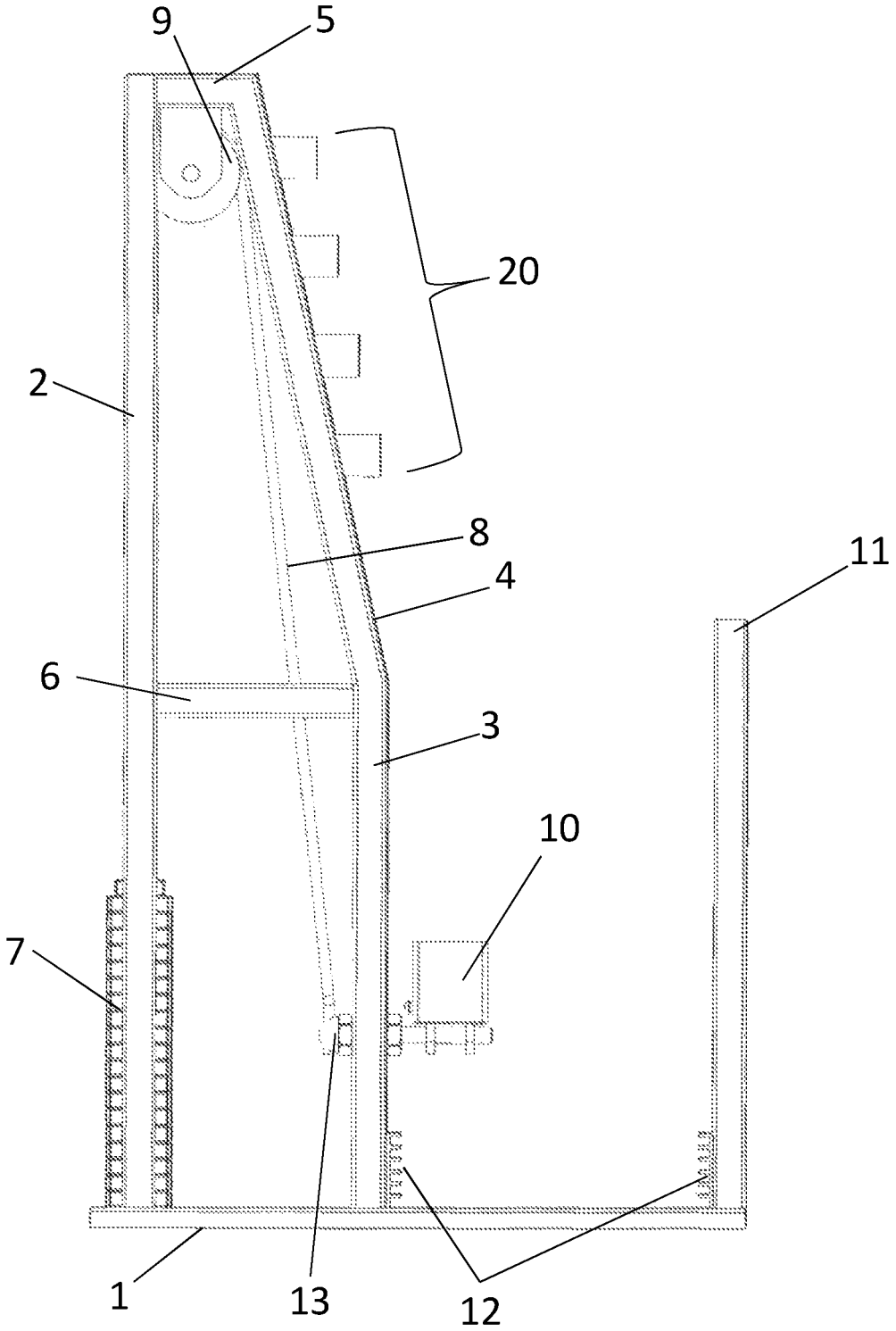
FIG. 5 is a left side elevational view of the power push apparatus, according to an embodiment of the present invention.

Preferred embodiments of the present invention and their advantages may be understood by referring to FIGS. 1-9 wherein like reference numerals refer to like elements.

In reference to FIGS. 1-5, an embodiment of the present invention is shown, wherein the gluteus maximus power push apparatus is provided with a base 1. Extending upwardly from the base are a tall vertical frame bars 2 and short vertical frame bars 3 which comprise the framing of the apparatus. In an exemplary embodiment, the tall vertical frame bars 2 are provided at about 70 inches in height, however this height may be modified as deemed appropriate.

In an embodiment, a front panel 4 extends from the short vertical frame bars 3 towards the tall vertical frame bars 2. Top horizontal frames 5 are provided at top end of the front panel 4 and connect the front panel to the tall vertical frame bars. In an embodiment, the framing is further provided with additional horizontal frame bars 6 which connect the top ends of the short frame bars 2 to a middle section of the tall vertical frame bars 3 to strengthen the framing.

In an embodiment, a selectable weight assembly 7 is provided on the framing, between the tall vertical frame bars 3. The selectable weight assembly is provided with one or more guide rods which run from the top of the framing, through a series of weighted plates, terminating at the base 1. A selectable rod is provided through the center of the weighted plates, the selectable rod having a plurality of apertures which line up with apertures provided in the weighted plates. A user is able to adjust the amount of weight resistance by placing a pin through a weighted plate, such that all plates above the pin are lifted when the apparatus is operated. Such a selectable weight system is known in the art.

In an embodiment, a cable 8 extends from the top of the selectable rod of the selectable weight assembly to a pulley 9, provided near the top of the framing. The pulley directs the cable to the foot assembly 10. In an embodiment, the pulley is 6 inches in diameter, however the size of the pulley is modified as deemed appropriate. The configuration is such that a user may place their foot on the foot assembly 10 and press down upon the foot assembly. The downward push force provided by the user foot will be transferred to the cable, which will cause the selected weight plates to be lifted. This downward push force, provided by the user, targets the user's gluteal muscles, providing effective exercise of the user's gluteus maximus. In an embodiment, clamp slider bolt 13 is provided to receive the cable 8 and foot assembly 10 such that the motion and energy provided by the user is transferred from the foot assembly to the cable. In an embodiment, the clamp slider bolt 13 crimps the cable to provide a secure connection.

In an embodiment, another pulley (not shown) may be provided, such that the cable is vertically oriented before reaching the foot assembly 10. In an embodiment, the additional pulley may be attached to a frame bar running across and connected to the horizontal frame bars 6. In another embodiment, the additional pulley may be attached to the rear of the front panel 4.

In an embodiment, the power push apparatus is further provided with a support bar 11. The support bar is provided so a user may lean or support their weight when using the power push apparatus, such that they do not lose their balance. In an exemplary embodiment, the support bar is provided at a height 36 inches from the base 1, however the height may be modified as deemed appropriate.

In an embodiment, the support bar 11 and short frame bars 2 are provided with a plurality of platform risers 12. The platform risers 12 are configured to accept an adjustable platform 15, such that the platform may be raised or lowered by placing on different riser levels. This configuration allows the apparatus to be adjusted for users of different heights.

Figure 6:
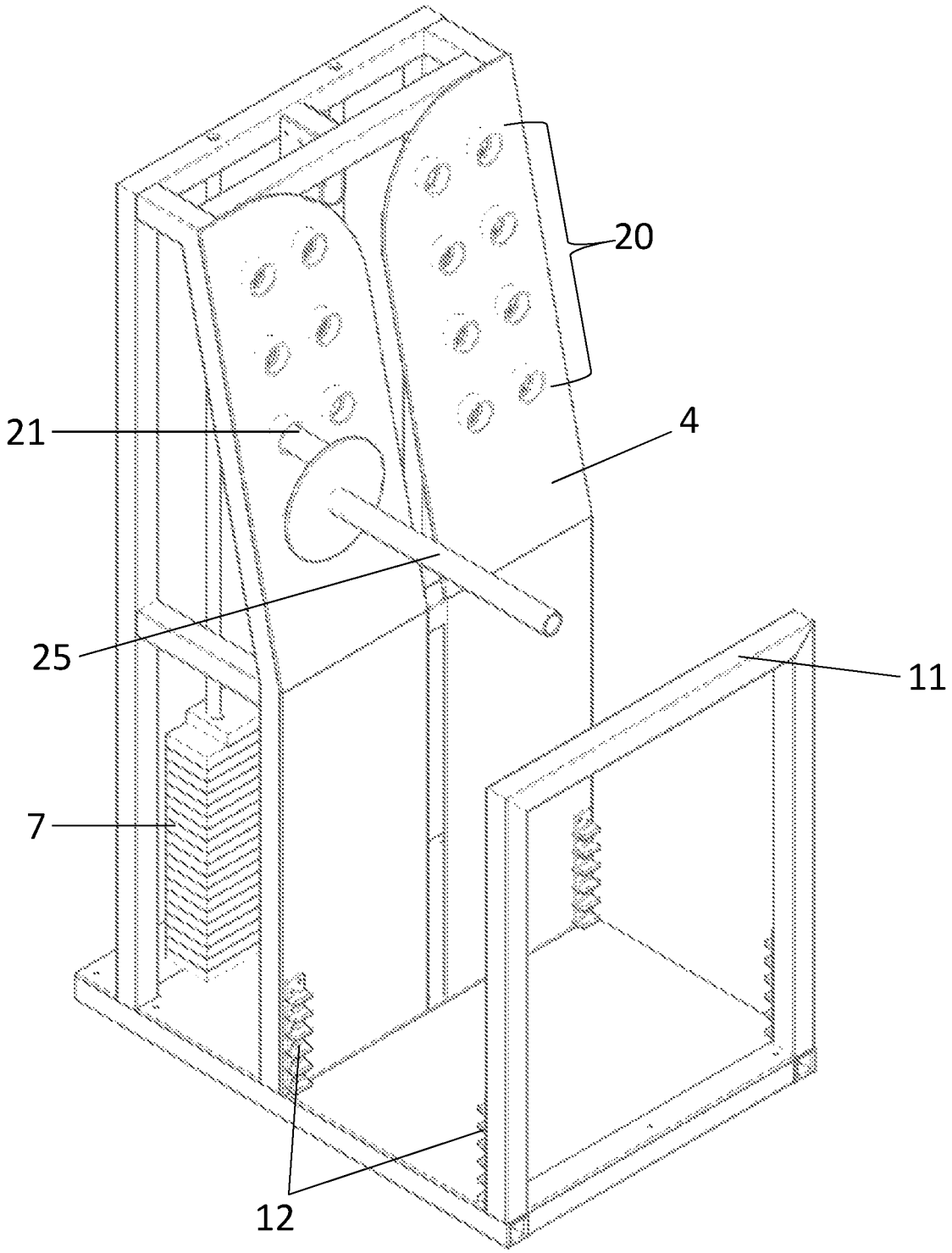
FIG. 6 is a perspective view of the power push apparatus, according to an embodiment of the present invention.
Figure 7:
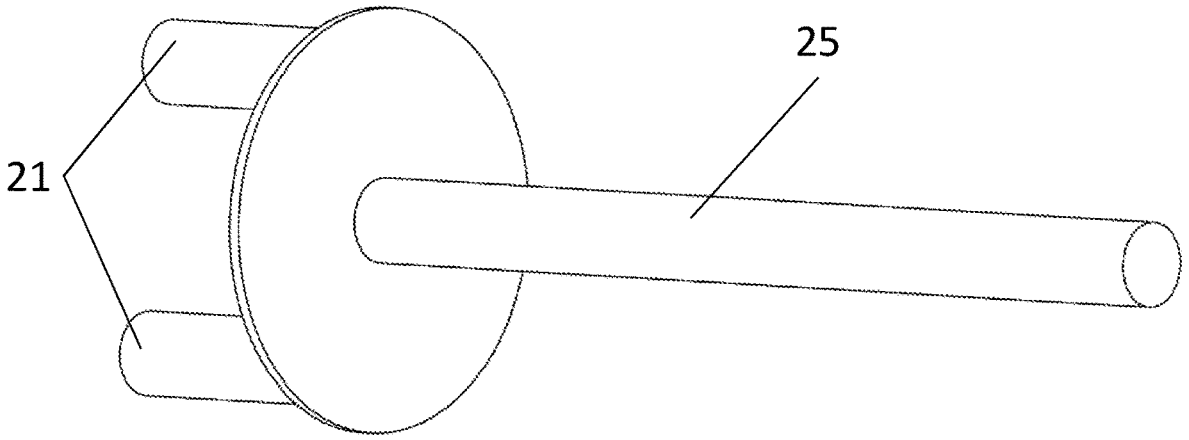
FIG. 7 is a perspective view of the support pad component of the power push apparatus, according to an embodiment of the present invention.

In reference to FIG. 6-7, an embodiment of the invention is shown, wherein the front panel 4 is provided with a tube array 20. The tube array is provided to accept the tube inserts 21 protruding from a support pad 25. The configuration allows the support pad to engage with the tube array, such that the support pad can be adjusted for users of different heights.

In an embodiment, a user places one foot on the platform 15 and their other foot upon the foot assembly 10. The user grabs the support pad 25 to retain their balance and push down upon the foot assembly 10, transferring force to the cable 8 and lift the selected weight plates of the selectable weight assembly 7. In an embodiment, the user places their bicep, cubital fossa, or shoulder on the bottom of the support pad 25, such that they may press against the support pad to provide additional downward force.

Figure 8:
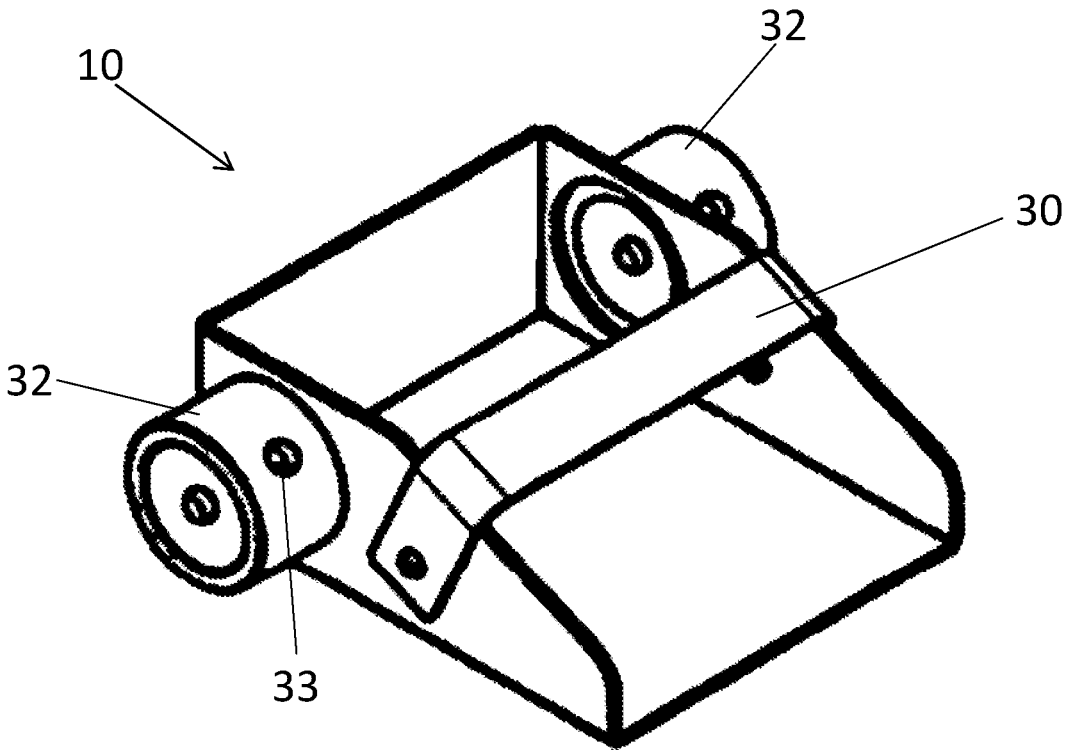
FIG. 8 is perspective view of the foot assembly component of the power push apparatus, according to an embodiment of the present invention.

In reference to FIG. 8, an embodiment of the foot assembly is shown, having a strap 30 and two foot assembly connectors 32 on both sides of the foot assembly. The connectors 32 are provided on both sides of the foot assembly, such that the foot assembly can be easily flipped to accommodate the left or right foot for use with the power push apparatus. The connectors are further provided with a through-hole 33, such that a locking pin (not shown) may be provided through the through-holes of the foot assembly and slide guide connector (43 shown in FIG. 9) to lock the foot assembly to the connector of the slide guide.

Figure 9:
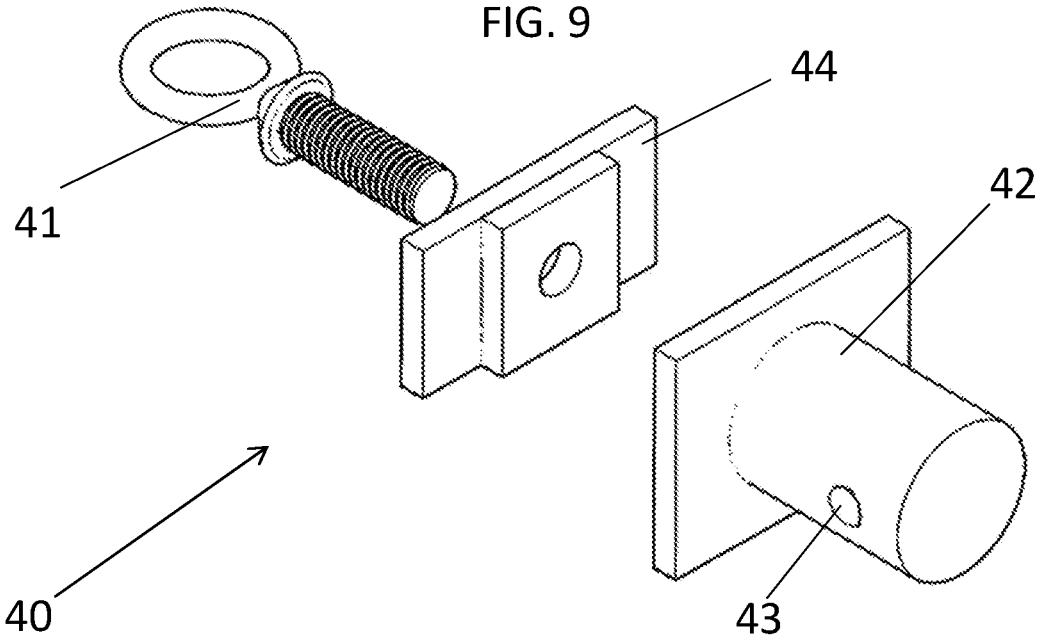
FIG. 9 is perspective view of the slide guide component of the power push apparatus, according to an embodiment of the present invention.

In reference to FIG. 9, an embodiment of a slide guide 40 is shown. In the embodiment, the slide guide is provided with a threaded eye bolt 41 to be received by the guide plate 44 and the slide guide connector 42. In an embodiment, the eye of the threaded eyebolt receives cable 9 to engage the selectable weight assembly 7. In another embodiment, as previously discussed, the eye maybe replaced with a clamp to crimp the end of the cable 9.

In an embodiment, the guide plate 44 and slide bolt connector 42 are provided with a rectangular protrusion which engages with the frame bars 3 to prevent rotation. In an embodiment, the slide guide connector 42 is provided with a cylindrical protrusion having a through hole to engage with the foot assembly via a locking pin. In an embodiment, the locking pin maybe or include a cotter pin, spring pin, magnetic pin, or other pin type known in the art.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. An exercise apparatus comprising:

a frame assembly;

a weight system having a plurality of weight plates in contact with the frame assembly;

a support bar defining a workout space between the frame assembly and the support bar, the workout space configured to accommodate a user;

a foot assembly in contact with the weight system and provided within the workout space, the foot assembly configured to receive the user's foot;

a tube array provided on the frame assembly; and one or more support pads each having a protrusion configured to be received by the tube array, wherein the foot assembly engages the weight system, wherein downward movement of the foot assembly is transferred through a single pulley to the weight system via a cable, and wherein the weight system provides a selectable resistance against downward movement of the foot assembly.

2. The apparatus of claim 1, wherein the selectable resistance is selected by engaging a predetermined number of the plurality of weight plates.

3. The apparatus of claim 1, the foot assembly comprising a foot basket having two annular protrusions configured to receive a cylindrical protrusion of a slide guide, the foot assembly further comprising a foot strap configured to secure a user's foot to the foot basket.

4. The apparatus of claim 1, wherein the tube array is comprised of 16 tubes configured to receive the one or more support pads.

5. The apparatus of claim 4, wherein the one or more support pads further consist of two tube inserts.

6. The apparatus of claim 1, further comprising one or more platform risers extending from the frame assembly and support bar into the workout space, wherein the one or more platform risers are provided to receive an adjustable workout platform.

7. An exercise apparatus, comprising:

a rod having a plurality of apertures;

a frame assembly;

a weight system having a stacked set of weights, each weight from the set of stacked weights having a hole, slideably disposed along the frame assembly, a subset from the set of stacked weights being configurable in connection with engagement of a pin lock through one of the plurality of apertures with the hole of a selected weight;

a single pulley;

a cable, disposed around the pulley, being removably attached to the weight plate;

a foot assembly connected to the cable, the subset of the selectable weight assembly presenting a counter weight to motion of the cable around the pulley;

a tube array disposed on the frame assembly;

a support bar disposed on a distal end of the apparatus away from the frame assembly, a workout space between the support bar and the frame assembly configured to define an area on an adjustable workout platform for an operator of the exercise apparatus; and one or more support pads disposed in the tube array.

8. The apparatus of claim 7, wherein the tube array is comprised of a plurality of cylindrical tubes.

9. The apparatus of claim 7, the foot assembly comprising a foot basket having two annular protrusions configured to receive a cylindrical protrusion of a slide guide, the foot assembly further comprising a foot strap configured to secure a user's foot to the foot basket.

10. The apparatus of claim 7, the tube array is comprised of 16 cylindrical tubes configured to receive the one or more support pads.

11. The apparatus of claim 7, wherein the one or more handgrips support pads further consist of two tube inserts.

12. The apparatus of claim 7, further comprising one or more platform risers extending from the frame assembly and support bar into the workout space, wherein the one or more platform risers are provided to receive the adjustable workout platform.

13. An exercise apparatus comprising:

a rod having a plurality of apertures;

a frame assembly;

a weight system having a stacked set of weights, each weight from the set of weights having a hole, slideably disposed along the frame assembly, a subset from the set of stacked weights being configurable in connection with engagement of a pin lock through one of the plurality of apertures with the hole of a selected weight;

one or more pulleys;

a cable, disposed around the one or more pulleys, being removably attached to the weight plate;

a foot assembly connected to the cable, the subset of the stacked set of weights presenting a counter weight to motion of the cable around the one or more pulleys;

a tube array disposed on the frame assembly;

a support bar disposed on a distal end of the apparatus away from the frame assembly, a workout space between the support bar and the frame assembly configured to define an area on the platform for an operator of the exercise apparatus;

one or more support pads disposed in the tube array; and a slide guide having a threaded eye bolt, a guide plate, and a foot assembly connector, wherein an eye of the threaded eye bolt receives the cable, wherein the threaded eye bolt threads through the guide plate and foot assembly connector, wherein the guide plate and foot assembly connector are configured to engage the frame assembly to prevent rotation of the foot assembly, and wherein the foot assembly connector is configured to receive the foot assembly.

* * * * *